United States Patent [19]

Monnier

[11] Patent Number: 5,042,433

[45] Date of Patent: Aug. 27, 1991

[54] DEVICE FOR STABILIZING THE TUBES OF THE BUNDLE OF A STEAM GENERATOR HAVING ANTI-VIBRATION BARS

[75] Inventor: Bernard Monnier, Feucherolles, France

[73] Assignee: Framatome, Courbevoie, France

[21] Appl. No.: 491,035

[22] Filed: Mar. 9, 1990

[30] Foreign Application Priority Data

Mar. 9, 1989 [FR] France ..... 89 03099

[51] Int. Cl.[5] ..... F22B 37/24

[52] U.S. Cl. ..... 122/510; 122/32; 122/511; 122/512

[58] Field of Search ..... 122/510, 511, 512, 493, 122/32, 33, 34

[56] References Cited

U.S. PATENT DOCUMENTS

| | | | |
|---|---|---|---|
| 4,137,967 | 2/1979 | Hirschle | 122/510 |
| 4,590,991 | 5/1986 | Cooper, Jr. et al. | 122/32 |
| 4,718,377 | 1/1988 | Haller | 122/510 |
| 4,747,373 | 5/1988 | Wepfer et al. | 122/510 |
| 4,753,197 | 6/1988 | Mullinax | 122/510 |
| 4,893,671 | 1/1990 | Lagally et al. | 122/510 |
| 4,895,204 | 1/1990 | Johnson et al. | 122/510 |

FOREIGN PATENT DOCUMENTS

| | | |
|---|---|---|
| 0214812 | 3/1987 | European Pat. Off. . |
| 2175078 | 11/1986 | United Kingdom . |

*Primary Examiner*—Henry C. Yuen

*Attorney, Agent, or Firm*—Pollock, Vande Sande & Priddy

[57] ABSTRACT

Arranged on the hemispherical dome forming the upper part of the bundle of the steam generator is a structure consisting of bows (16) in the form of a portion of a ring and connecting hoops (18). The anti-vibration bars (15) introduced between two layers of adjacent tubes (5) of the bundle are connected, at their outer end, to brackets (17) fastened to the bows (16) in a perpendicular direction. Some anti-vibration bars are fastened to the hoops (18). The anti-vibration bars are screw-fastened to the brackets (17) or the hoops (18). The stabilizing device can also include a comb-shaped anti-flyoff yoke which can be introduced under the tubes placed in the upper part of the dome and then rotated through 90° in order to be fastened to a bow (16).

5 Claims, 6 Drawing Sheets

DEVICE FOR STABILIZING THE TUBES OF THE BUNDLE OF A STEAM GENERATOR HAVING ANTI-VIBRATION BARS

FIELD OF THE INVENTION

The invention relates to a device for stabilizing the tubes of the bundle of a steam generator, having anti-vibration bars inserted between curved parts of the tubes of the steam generator.

BACKGROUND OF THE INVENTION

Steam generators, especially the steam generators of pressurized-water nuclear reactors, have tubes bent in the form of a U, with the two legs of the U set at their ends in a tube plate. The curved parts of the tubes of the bundle which are located next to one another in its upper part have radii of curvature different from one another and are placed adjacent to one another to form a form substantially hemispherical form, dome.

During the operation of the steam generator, pressurized water at high temperature circulates in the tubes of the bundle and the feed water is brought in contact with the outer surface of these tubes, along which it travels in the vertical direction, thereby heating up and then evaporating, to emerge in the form of steam in the upper part of the generator.

The circulation of fluid in contact with the tubes can give rise to vibrations which are liable, to cause damage to these tubes if they are not held securely.

The straight part of the tubes is held securely by rigid elements located at uniform distances from one another over the height of the bundle. The curved parts of the tubes of the bundle forming the dome must also be held, and for this purpose spacer bars are usually inserted between the adjacent tubes of the bundle and arranged in substantially radial directions of the dome. These spacer bars are generally connected two by two in an articulated manner at one of their ends located towards the interior of the dome and are arranged angularly to form V-shaped structures.

The ends of the anti-vibration bars opposite their ends articulated on one another generally project relative to the tubes forming the outer layer of the dome.

Various means for fastening those ends of the anti-vibration bars to fastening elements located on the upper surface of the dome have been proposed.

It has been proposed, for example, to weld the ends of the anti-vibration bars to curved elements arranged in mid-planes of the dome.

It has also been proposed to fasten the ends of the anti-vibration bars, for example by welding, to substantially parallel rings resting on the upper surface of the dome.

At all events, the fastening of the anti-vibration bars requires complex operations usually involving welds which have to be made in the vicinity of the tubes of the bundle.

There are also known anti-flyoff devices for stabilizing the curved parts of the tubes of the bundle, which consist of yokes engaged on the last row of tubes and of which the ends projecting relative to the surface of the dome can be fastened by welding to elements for the retention of the anti-vibration bars, these elements being arranged, for example, in mid-planes.

Also known are structures for the retention of the tubes of a steam generator in the region of the dome, which consist of bows in the form of a portion of a ring surrounding the outer surface of the dome and arranged in mid-planes of the dome which all pass through the same diameter parallel to the rows of tubes. The bows have cutouts allowing them to match perfectly the upper form of the dome and are rigidly connected to one another by means of hoops perpendicular to the bows and screwed to these bows.

The assembly composed of the bows and of the hoops forms a structure which rests freely on the dome. This structure is retained on the dome under the effect of its own weight.

In some embodiments, holes are made in the bows in order to engage therein the anti-vibration bars which can be held by means of screwed connections.

This arrangement is unsatisfactory inasmuch the engagement of the anti-vibration bars into the bows is an operation which is difficult to carry out.

SUMMARY OF THE INVENTION

It is an object of the invention to provide a device for stabilizing the tubes of the bundle of a steam generator, having anti-vibration bars inserted between curved parts of the tubes of the steam generator which are bent in the form of a U, with the two legs of the U set at their ends in a tube plate, the curved parts of the tubes of the bundle having radii of curvature different from one another and being arranged adjacent to one another to form a structure of substantially hemispherical dome, and being separated by anti-vibration bars which are each arranged in substantially radial directions between the curved parts of tubes of the bundle in a mutually adjacent position, and bows in the form of a portion of a ring surrounding the surface of the dome and arranged in planes all passing through the same diameter of the dome and connected by means of hoops perpendicular to the bows, this stabilizing device making it possible to fasten the anti-vibration bars quickly and easily to the structure formed by the bows and hoops.

To this end, a plurality of fastening brackets are fixed to each of the bows perpendicularly relative to the bows and relative to the anti-vibration bars which are each fastened, at an outer end, to a bracket or to a hoop by mechanical screwing means.

BRIEF DESCRIPTION OF THE DRAWINGS

In order that the invention may be more clearly understood, an embodiment of a device according to the invention for stabilizing the tubes of the bundle of a steam generator of a pressurized-water nuclear reactor will now be described by way of example with reference to the accompanying drawings.

DESCRIPTION OF PREFERRED EMBODIMENT

Figure 1:
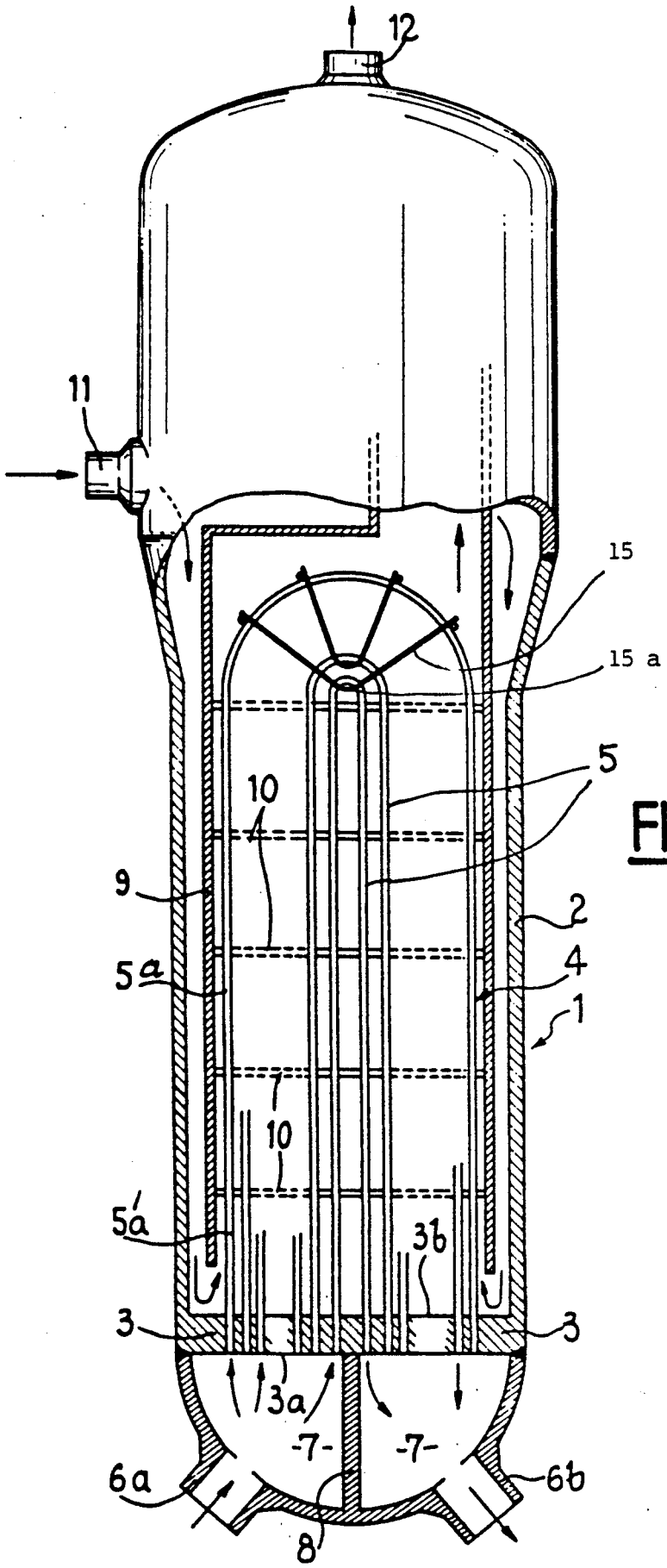
FIG. 1 is a front elevation, partially in section, of a steam generator of a pressurized-water nuclear reactor, comprising a device according to the invention for stabilizing the tubes of the bundle.

FIG. 1 shows a steam generator of a pressurized-water nuclear reactor, 1 comprising an outer casing 2 connected, in its lower part, to a tube plate 3 of great thickness.

The casing 2 contains the bundle of tubes of the steam generator, which consists of tubes 5 bent in the form of a U and having, in their upper part, semicircular bends of a radius of curvature decreasing from the outside inwards and forming the dome of the steam generator.

The straight parts or legs 5*a* of the tubes of the bundle are set at their ends in the tube plate 3, so as to open into a water box 7 separated by a partition 8 into two parts.

The pressurized water of the nuclear reactor enters one of the parts of the water box 7 via an inlet connection 6*a*, circulates in the tubes of the bundle and then emerges from the other part via an outlet connection 6*b*.

The bundle of tubes 5 is surrounded by a bundle casing 9 making it possible to channel the feed water, entering the casing of the steam generator via an inlet connection 11. The feed water of the steam generator first circulates from top to bottom in the annular space surrounding the bundle casing 9 and then from bottom to top in contact with the tubes 5 of the bundle, so as to heat up, then evaporate and emerge in the form of steam via the upper outlet connection 12 of the steam generator.

The upper part of the bundle of tubes 5 is formed by of placing next to one another of bends of semicircular form, the radii of which decrease from the outside of the bundle inwards.

Furthermore, the various successive layers of tubes of the bundle, which are parallel to the central layer shown in FIG. 1, have bends of decreasing diameter, with the result that the upper part of the bundle forms an assembly of substantially hemispherical form, called a dome.

The straight part 5*a* of the tube 5 is held by spacer plates, 10 which prevent the tubes from vibrating when the steam generator is in operation, fluids when the steam generator is in operation fluids.

The bent parts of the tubes located at the upper end of the bundle are held by means of anti-vibration bars 15 in the form of calipers articulated at their inner ends 15*a* and introduced between the successive rows of tubes 5 in the region of the bends.

Moreover, the device for the retention of the upper part of the bundle comprises bows 16, to which are fastened brackets 17 perpendicular relative to the bows number of bends in the upper row 31 of bends of the tubes 5 of the bundle planes of the dome all passing through the same diameter corresponding to the transverse direction of the bundle parallel to the water channel located between the small bends in the inner part of the bundle.

Figure 2:
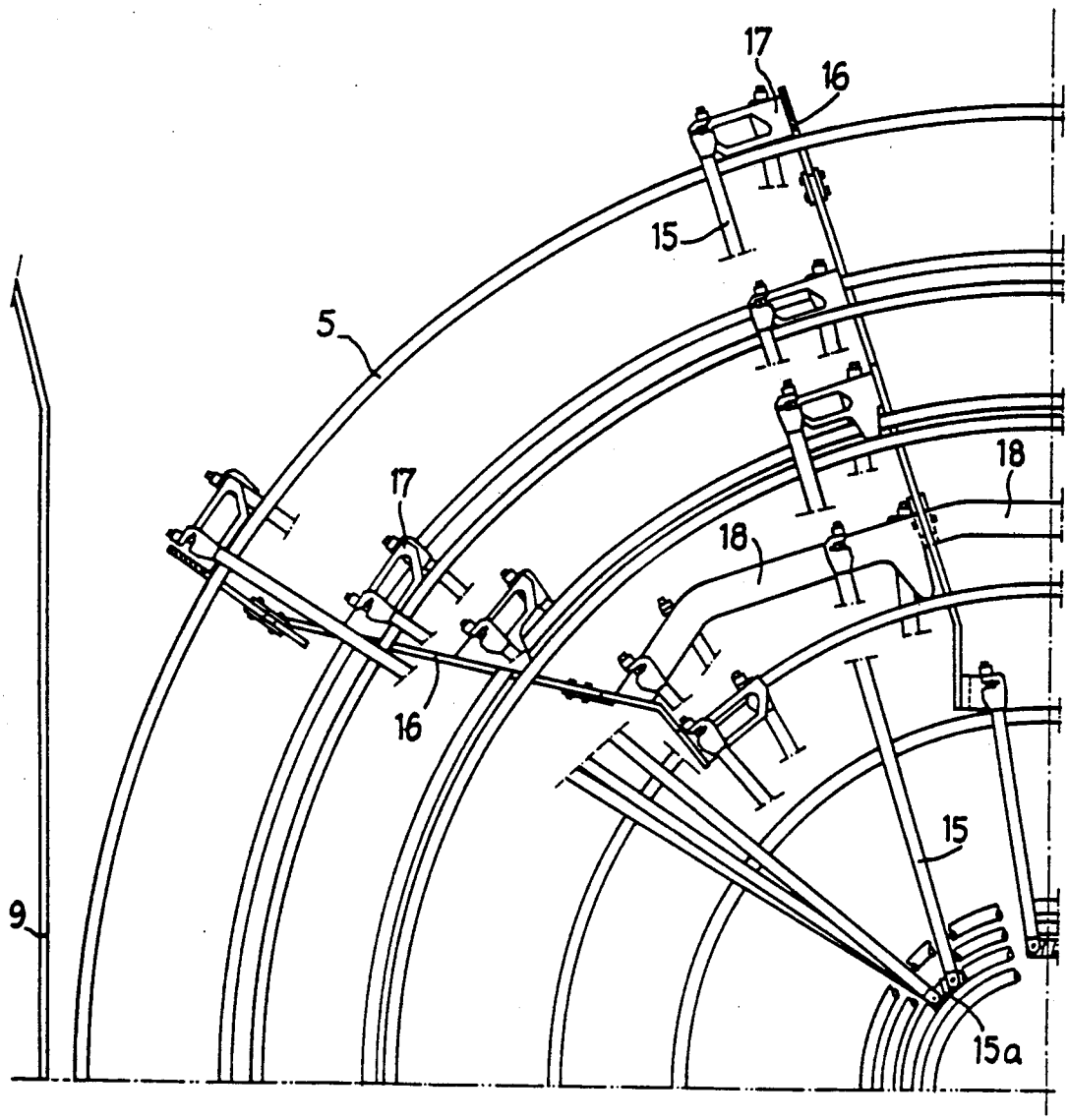
FIG. 2 is a front elevation of the upper part of the bundle on a larger scale.
Figure 3:
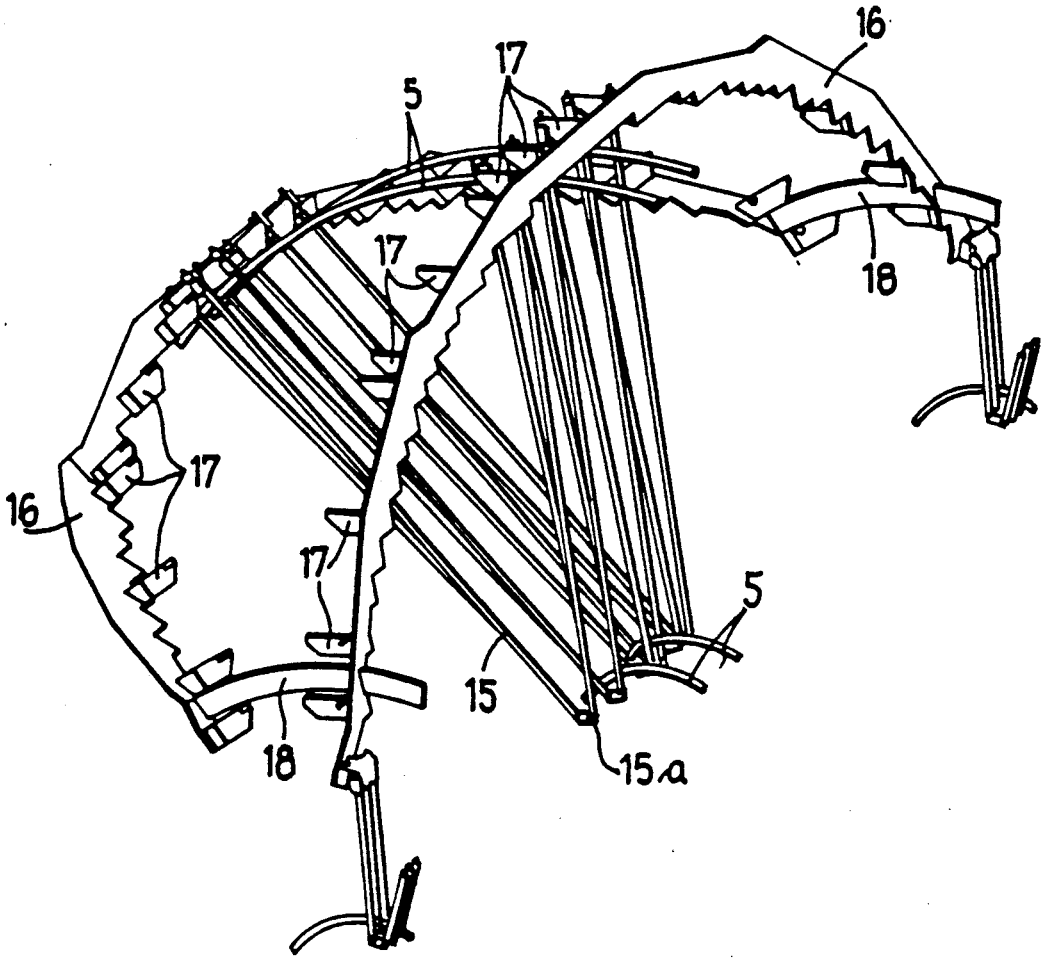
FIG. 3 is a partial perspective view of the stabilizing device according to the invention.

As can be seen in FIGS. 2 and 3, the bows 16 have cutouts and deflections, allowing them to match the outer form of the dome.

The bows 16 are connected to one another by means of hoops 18 which are bolted to the bows and which ensure the retention of the entire structure of the bows which rests on the upper end of the dome. The retention assembly consisting of the bows 16 and of the hoops 18 is held on the dome under the effect of its own weight. Some anti-vibration bars 5 are connected directly to the hoops by means of screwed connections 20 which will be described in more detail hereinbelow.

Figure 4:
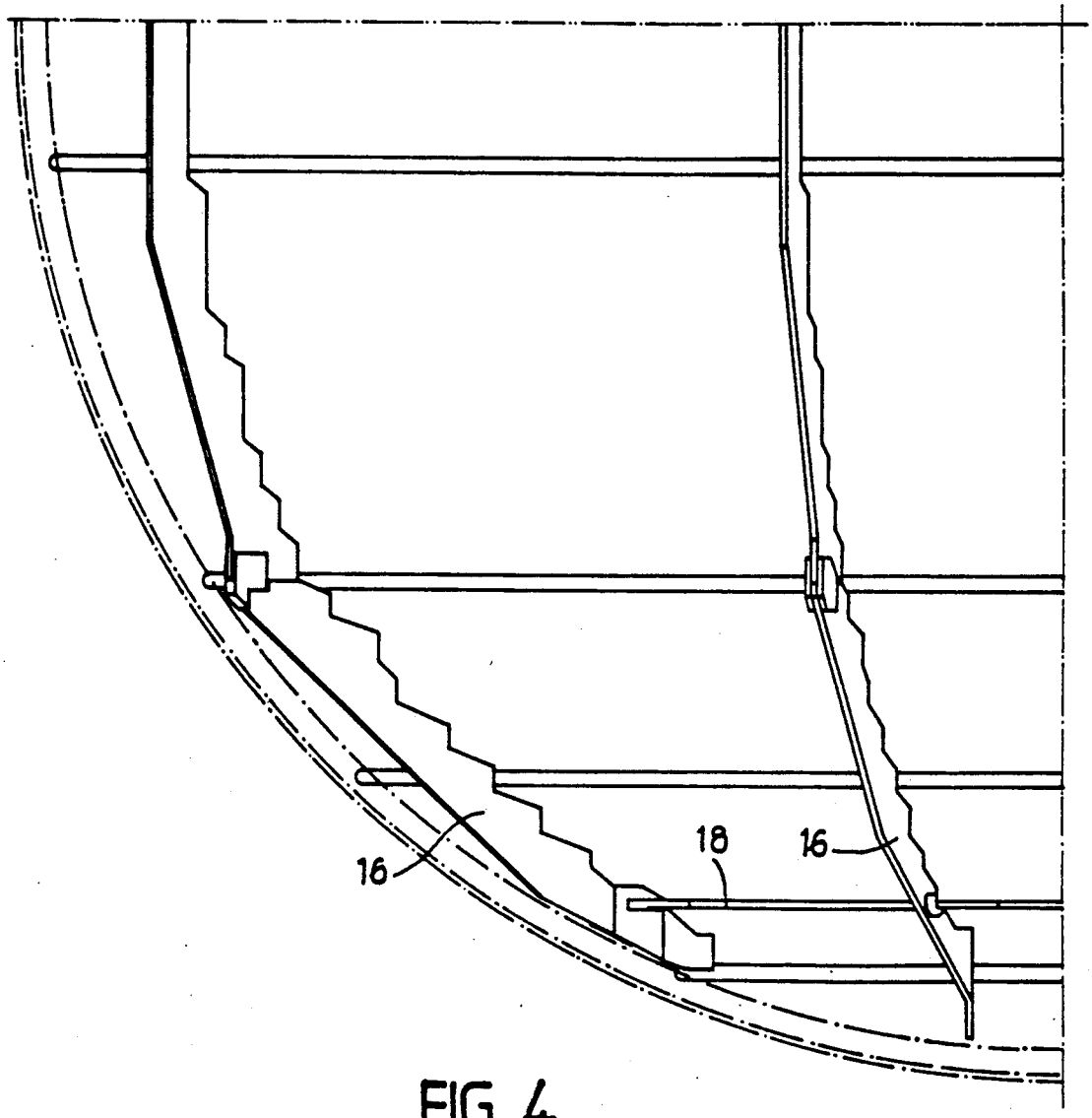
FIG. 4 is a top-half view of the bows and hoops to which the anti-vibration bars are fastened.

FIG. 4 shows the four bows 16 forming the upper retention structure of the steam generator and connected to one another by means of a hoop 18. The hoops 18 have the form of an arc of a circle and are arranged in vertical planes parallel to the layers of tubes.

Figure 5:
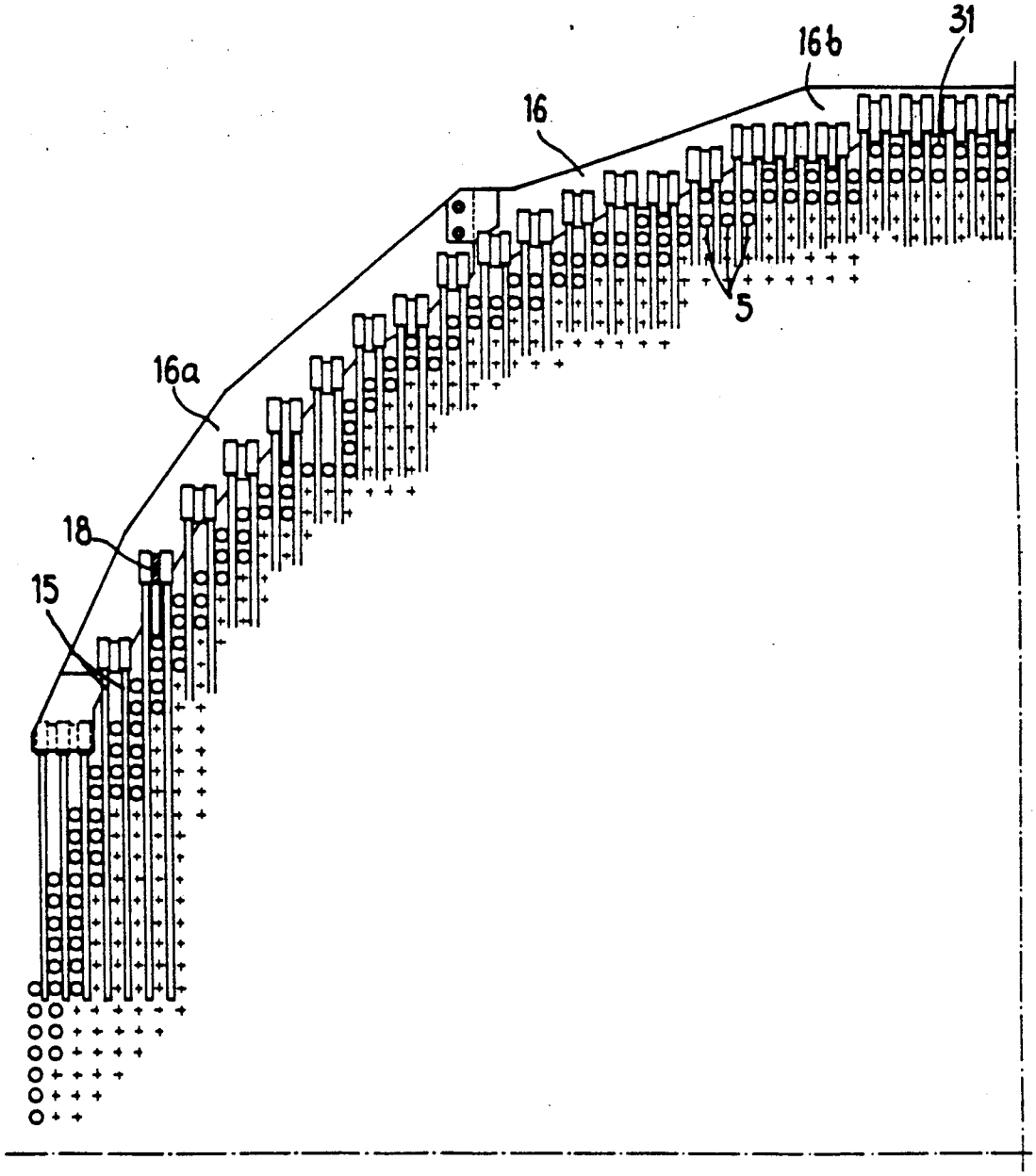
FIG. 5 is a sectional view in a plane of symmetry through the upper part of the bundle of the steam generator, showing the devices for fastening the anti-vibration bars to a bow.

FIG. 5 shows a bow 16 consisting of successive parts 16*a*, 16*b*, 16*c* connected to one another by means of screwed connections.

Also shown are two hoops 18 for joining together all the bows, to which are fastened anti-vibration bars 15 inserted between the rows of tubes 5 of the bundle.

The other anti-vibration bars inserted between the rows of tubes 5 are fastened to the bows by means of brackets 17.

Figure 6:
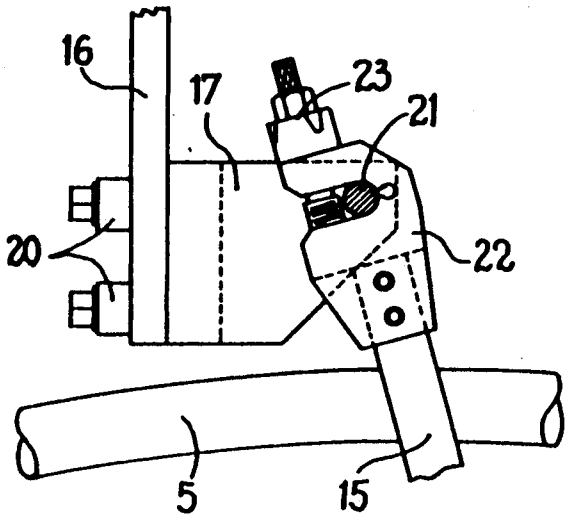
FIG. 6 is a detail view of a device for fastening an anti-vibration bar to a bracket, according to a first embodiment.

FIG. 6 shows a first type of bracket 17, making it possible to fasten an anti-vibration bar 15, the bracket 17 being connected to the end of a bow 16 by means of screwed connections 20.

A pivot 21 is fastened to the bracket 17 and the anti-vibration bar 15 carries an end fork 22 which can be engaged laterally on the pivot 21. The clamping and fastening of the anti-vibration bar are obtained by means of a screw/cup assembly 23 effecting the clamping of two jaws of the fork 22 on the pivot 21. The screw head is locked against of rotation by means of a cup which can be turned down into cavities of the screw head.

Figure 7:
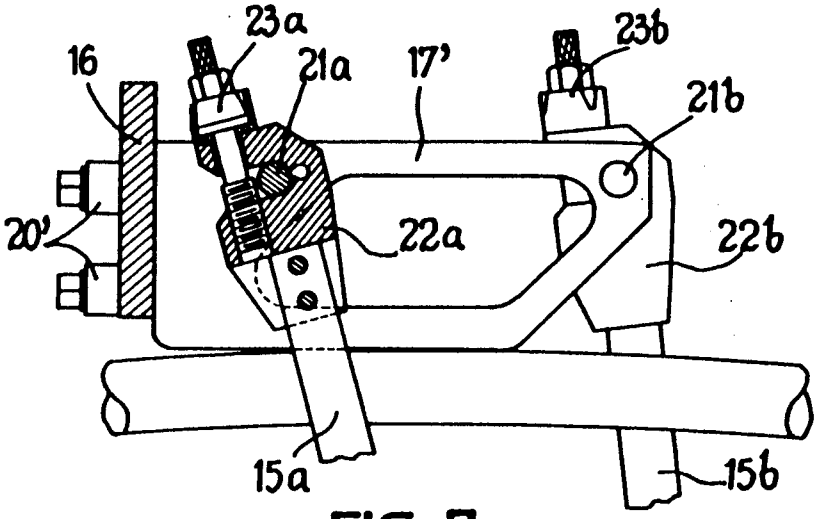
FIG. 7 is a detail view of the means for fastening two anti-vibration bars to a bracket, according to a second embodiment.

FIG. 7 shows a second type of bracket 17′ fastened to the upper end of a bow 16 by means of a screwed connection 20′.

The bracket 17′ makes it possible to fasten two anti-vibration bars 15*a* and 15*b* by means of forks 22*a* and 22*b* engaged on corresponding pivots 21*a* and 21*b* fixed to the bracket 17′. The anti-vibration bars are engaged laterally on the corresponding pivots 21*a* and 21*b* and are clamped in place by means of screw connections 23*a* and 23*b*.

Some anti-vibration bars 15 are fastened to a pivot fixed to a hoop 18.

At all events, the installation and fastening of the anti-vibration bars can be carried out very quickly and without the need for welding.

Moreover, the entire retention structure consisting of the bows 16, the hoops 18 and of the fastening brackets of the anti-vibration bars is fixed to all the anti-vibration bars which form a structure of high stability resting on the upper part of the dome of the steam generator.

Figure 8:
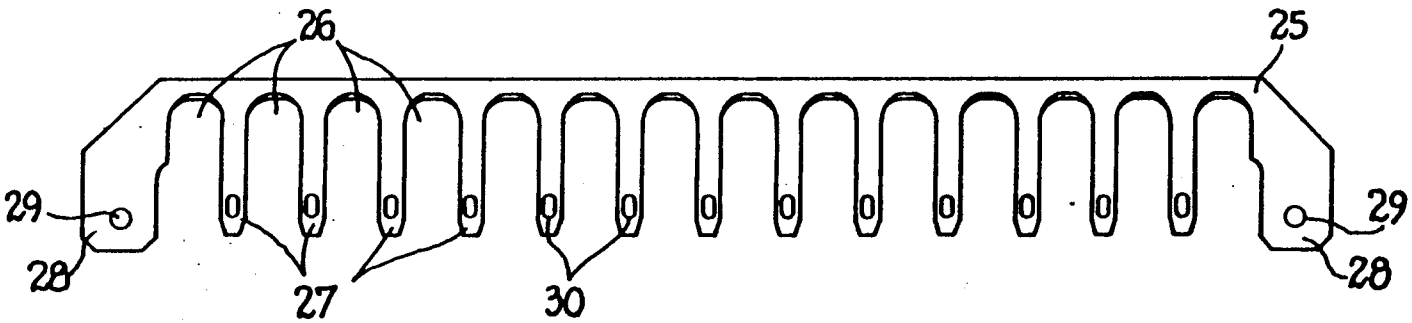
FIG. 8 is a front view of an anti-flyoff retaining yoke according to the invention for the retention of the upper tubes of the dome of a steam generator.

FIG. 8 shows a retaining yoke 25 in the form of a comb, of which the spaces 26 located between successive teeth 27 have a width slightly greater than the diameter of the tubes of the steam generator.

The comb 25 comprises end parts 28 pierced with fastening holes 29, and each of the teeth 27 likewise has an oblong hole 30 making it possible to fasten the comb underneath the last row of tubes of the steam generator, as will be explained below.

Referring to FIG. 5, it can be seen that the number of bends in the upper row 31 of bends of the tubes 5 of the bundle in identical to the number of spaces 26 located between the teeth of the comb 25.

The comb 25 can be used for the anti-flyoff retention of the anti-vibration bars, being slid into a horizontal position underneath the row 31, in such a way that the spaces 26 correspond to the positions of the upper bends of the tubes 5.

The comb 25 is then turned upwards through 90°, so that its end parts 28 and its teeth 27 coincide with a face of the bow 16 located immediately above the row of bends 31. The bow 16 has holes coinciding with the holes 29 and studs coinciding with the holes 27 for the installation and screw fastening of the comb on the bow 16. The comb 25 thus ensures an anti-flyoff retention of the anti-vibration bars.

The installation and fastening of the comb can be carried out quickly and efficiently, without the need for welding operation.

The anti-vibration bars may be fastened on the brackets fixed to the bows or on the hoops by the use of end forks of the anti-vibration bars which are clamped on a pivot fixed to the bracket or to the hoop.

It is possible to use any number of brackets, making it possible to fasten a single anti-vibration bar or several bars.

The structure formed by the bows and the hoops may be different from that described and comprise any number of bows or hoops. In particular, more than two hoops in one or more parts can be used.

The comb-shaped yokes will preferably be placed on the bows located towards the center of the dome of the steam generator, but it is also possible to arrange such anti-flyoff yokes on all the bows of the retention structure.

The invention applies to all steam generators having an upper part which forms a dome of substantially hemispherical form and on which is placed a retention structure comprising bows and hoops.

I claim:

1. Device for stabilizing tubes of a bundle of a steam generator, comprising anti-vibration bars between curved parts of said tubes bent in a form of a U, said tubes having two straight legs set at ends thereof in a tube plate, said curved parts of said tubes having radii of curvature different from one another and being located adjacent to one another to form a substantially hemispherical dome, and being separated by anti-vibration bars which are each arranged in substantially radial directions between said curved parts of said tubes in a mutually adjacent position, and bows in the form of a portion of a ring surrounding an outer surface of said dome and arranged in planes all passing through a same diameter of said dome and connected by hoops perpendicular to said bows, said device further comprising a plurality of fastening brackets fixed to each said bow perpendicularly relative to said bow and relative to said anti-vibration bars which are each fastened, at an outer end thereof, to one of a bracket and a hoop my mechanical screwing means.

2. Stabilizing device according to claim 1, wherein said brackets and said hoops have laterally pivots perpendicular relative to said bracket and said hoop, and said anti-vibration bars comprise an end fork having two jaws adapted to be engaged on said pivot and a means for screw clamping said jaws on said pivot.

3. Stabilizing device according to claim 1, comprising brackets for fastening a single anti-vibration bar and brackets for fastening two anti-vibration bars.

4. Stabilizing device according to claim 1, further comprising an anti-flyoff yoke for the anti-vibration bars of the bundle, arranged in the upper part of the dome and comprising a comb having notches located between successive teeth, said notches having a width which is greater than a diameter of a tube of the bundle, and end piece having holes for fastening said comb to a bow.

5. Stabilizing device according to claim 4, wherein each of the teeth of the comb has an oblong hole adapted to be engaged onto a positioning stud fixed to a corresponding bow.

* * * * *